United States Patent [19]

Strand

[11] Patent Number: 5,002,400

[45] Date of Patent: Mar. 26, 1991

[54] CONTAINER FOR LIFTING, TRANSPORTATION AND STORAGE OF BULK MATERIAL

[75] Inventor: Olaf Strand, Porsgrunn, Norway

[73] Assignee: Norsk Hydro a.s., Oslo, Norway

[21] Appl. No.: 454,504

[22] Filed: Dec. 21, 1989

[30] Foreign Application Priority Data

Dec. 21, 1988 [NO] Norway ..... 885699

[51] Int. Cl.[5] ..... B65D 33/10; B31B 1/26

[52] U.S. Cl. ..... 383/8; 383/24; 383/109; 383/7; 493/231; 493/255

[58] Field of Search ..... 383/7, 8, 24, 27, 109, 383/111, 116, 126, 907; 493/231, 255

[56] References Cited

U.S. PATENT DOCUMENTS

| | | | |
|---|---|---|---|
| 3,789,897 | 2/1974 | Saito | 383/24 |
| 4,191,229 | 3/1980 | Skaadel et al. | 383/7 |
| 4,628,535 | 12/1986 | Tetenborg | 383/24 |
| 4,710,967 | 12/1987 | Petschner | 383/8 |

FOREIGN PATENT DOCUMENTS

| | | | |
|---|---|---|---|
| 41586 | 12/1981 | European Pat. Off. | 383/7 |
| 420704 | of 1981 | Sweden . | |
| 2026981 | 2/1980 | United Kingdom | 383/24 |

*Primary Examiner*—Stephen Marcus
*Assistant Examiner*—Jes F. Pascua
*Attorney, Agent, or Firm*—Wenderoth, Lind & Ponack

[57] ABSTRACT

A flexible container is formed from a hose-like blank having two diametrically opposite longitudinal slots or holes and at least one intermediate slot or hole. One half of the hose-like blank is inserted through the intermediate slot in such way that one inner sack, one outer sack and at least one integral lifting loop defined by material areas are formed. Two material areas are formed by material sections between the opposite slots and the intermediate slot extending from the outer sack directly into the inner sack. A third material area is formed by a material section between the opposite slots and extending from the outer sack between the first two material area and into the inner sack.

25 Claims, 3 Drawing Sheets

CONTAINER FOR LIFTING, TRANSPORTATION AND STORAGE OF BULK MATERIAL

BACKGROUND OF THE INVENTION

The present invention relates to a flexible intermediate bulk container (FIBC) for lifting, transportation and storage of bulk material. The FIBC is formed by inserting one half of a hose-like blank into another half thereof, thus forming an inner sack and an outer sack. The FIBC includes a suitable common or separate bottom, and at least one lifting loop. The invention relates also to a process of manufacturing such flexible container. The flexible container is intended as a container for lifting, transportation and storage of bulk material such as powderous granular fertilizer, ground or unground grain, Portland cement, coal, etc., in quantities of several hundred kilos per container.

There is known a sack-like container for transportation of bulk material from, e.g., SE Patent Specification No. 420,704, where one half of a hose-like blank is inserted through a slot into the other half to form outer and inner sacks. The middle of the hose-like blank forms in the finished product a material loop at the top section of the container. This material loop is used as a lifting eye during transportation and lifting of the flexible container. Such lifting eye formed by a material loop from the inner sack partly crosses the longitudinal axis of the container below a lifting means and continues as an integral part of the outer sack. When the container is filled, this crossing will contribute to a contraction of the opening in the lifting eye. This complicates the application of the lifting means to such a degree that one has to do the operation manually. The contractions of the lifting eye will be more severe if the container is filled up to a maximum extent. The contractions of the lifting eye increase the stress and strain on the material of the container and thus reduce the carrying capacity of the container. To make use of such container, the material loop forming the lifting eye has to be made relatively long. This results in the ratio between the carrying capacity and the material consumption being decreased, whereas the manufacturing costs are increased correspondingly. In addition, the relatively long material loop results in reduced ability for transportation and storage of this type of flexible container in places with restricted headroom.

SUMMARY OF THE INVENTION

The object of the present invention is to provide a flexible container not featuring the aforementioned disadvantages, and wherein:

the ratio between carrying capacity and material consumption is increased, manufacture is simple and manufacturing costs are moderate, handling during transport and storage is simple.

The species feature of the invention is that is has at least one integral lifting loop formed by material areas which can be split into several material areas. Two material areas are formed by a material section between two slots located diametrically opposite each other at a transverse center line of a hose-like blank and an intermediate slot that extend from an outer sack directly into an inner sack. A third material area comprises a material section between the diametrically opposite slots and extends from the outer sack, between the first two material areas directly into the inner sack.

This arrangement provides that the integral material sections forming lifting loops cross the longitudinal axis of the container above a lifting means. The integral lifting loops also are direct continuations of the walls of the outer and inner sacks. Thus, all the vertical fibers in the wall fabric carries the load of the filled container, and the lifting strain is uniformly and equally distributed to the walls in the inner and outer sacks without any contraction effects or stress concentrations in the fabric of the walls. Such lifting loops also enable a lower lifting height for the FIBC.

Due to the aforementioned features, the degree of filling and the lifting capacity can be substantially increased compared to the container mentioned in SE Patent Specification No. 420,704. This results in the ratio between carrying capacity and the material weight being increased and the manufacturing costs per kilo net weight accordingly being lowered. Tests have shown that by transporting the same amount of bulk material a saving of approximately 10–20% can be achieved in material costs by using the container of the invention compared to the container mentioned in SE Patent Specification No. 420,704.

BRIEF DESCRIPTION OF THE DRAWINGS

The invention will be described in more detail, by the way of example only, with reference to the accompanying drawings in which.

DETAILED DESCRIPTION OF THE INVENTION

Figure 1:
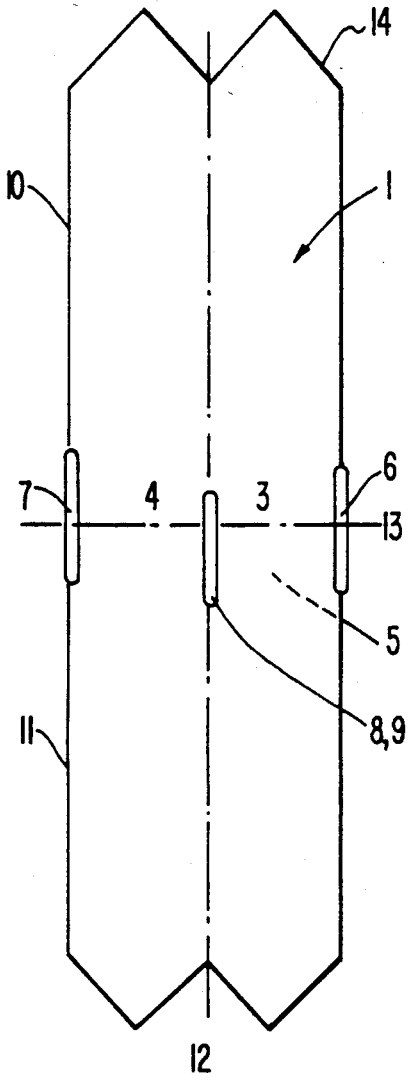
FIG. 1 is an elevation view of one example of a hose-like blank used in forming a flexible container as illustrated in FIG. 5.
Figure 2:
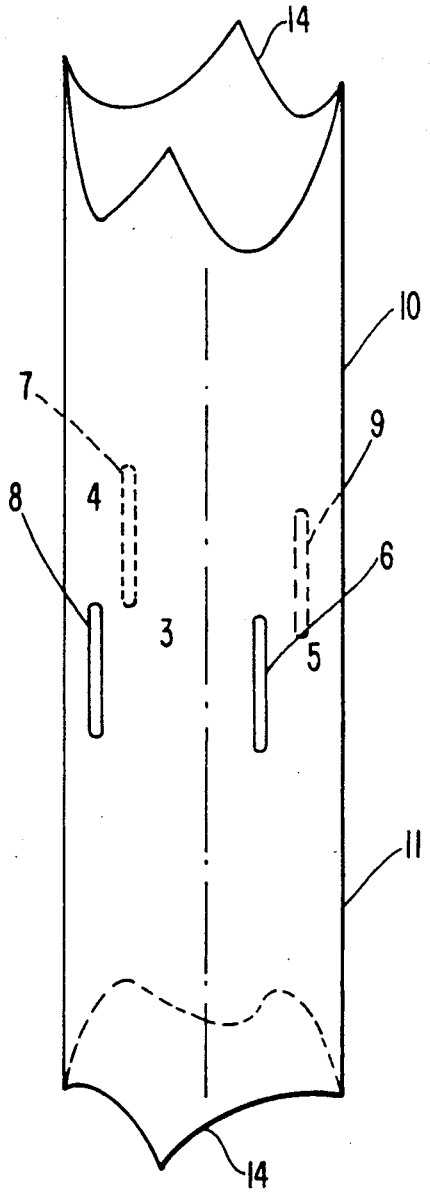
FIG. 2 is a perspective view of the hose-like blank in an "inflated" state.

FIG. 1 illustrates in deflated or flattened form and FIG. 2 illustrates in inflated form a hose-like or tubular blank 1 employed in a container according to the invention. The hose-like blank can, for example, be manufactured from uncoated circular-woven polypropylene fabric or from a coated circular woven polyethylene fabric. Selection of the container fabric depends on what application and type of bulk material for which the container will be used. The diameter and length of the hose-like blank should be defined depending on what volume is needed. The hose-like blank 1 has formed therein adjacent a transverse center line 13 thereof three or four longitudinal slots or holes or openings 6, 7, 8 and/or 9.

As will be apparent from the following, an inner sack or container portion of the container is made by inserting one half 10 of the hose-like blank into the other half 11 through one of the middle or central slots or holes 8 or 9. The reason why there are two slots 8, 9 is due to manufacturing simplicity. It is an easier operation to stamp holes in the hose-like blank when it is laid flat than doing the same operation when the hose-like blank is "inflated". The extra slot or hole 8 or 9 can be used as an opening for filling of the free flowing bulk material into the sack (see FIG. 4*b*). As mentioned, the simplest way to make the slots o holes is when the hose-like blank is laid flat. FIG. 1 illustrates a hose-like blank where the slots 6, 7, 7 and 9 are situated at the side edges and at the longitudinal axis 12, respectively. Thus, slots 6, 7 are formed at opposite lateral positions approximately 90° offset from slot 8 relative to the circumference of blank 1.

As it will be apparent from the following description, material sections 3, 4 and 5, respectively between the slots/holes 6 and 8, between 7 and 8, and between 6 and 7, form material areas or portions 15, 16, 17 that are joined together to form at least one lifting loop in the finished manufactured flexible container. The slot 9 serves in this example as an opening for filling of the container. The slots 6, 7 extend from the transverse center line 13 between the two halves 10, 11 substantially the same distance in opposite directions. The lengths of these slots may vary depending on the volume, application and material chosen for the flexible container. The slots or perforations 8, 9 can be arranged at the central part of the hose-like blank, equivalent to slots 6, 7 and may have the same length. However, it is considered to be more practical to let slots 8, 9 extend from above the center line 13 in a direction toward the half part 11 of the hose-like blank that represents the outer sack of the finished flexible container. The slots 8, 9 preferably can be shorter than slots 6, 7, e.g. half of the length thereof.

In FIG. 1 the bottom part of the hose-like blank is shown to be cut so that the ends forms star-shaped flaps 14. These flaps will form the bottom of the finished container. Depending on the material, they can either be fastened by sewing or by use of glue. The construction of the bottom is not considered to be a part of the present invention, therefore it will not be discussed further. However, it should be mentioned that the construction of the bottom is not restricted to the star-shaped construction. Various types of bottoms can be employed, such as a "cross bottom" or "inserted bottom". Depending on the application, separate bottoms or a common bottom can be used for the inner sack and the outer sack. For example, see GB Patent No. 1,580,576 and EP Patent Specification No. 84,110,404.5.

Figure 3:
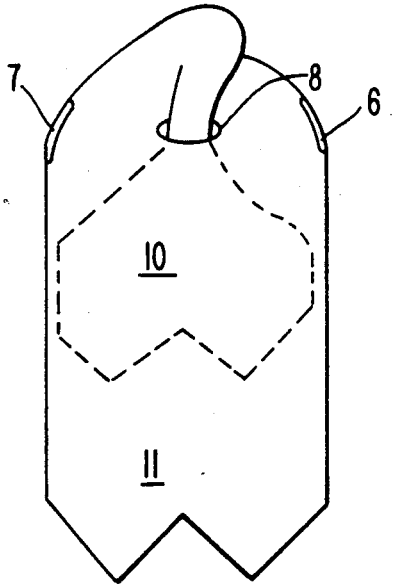
FIG. 3 is a perspective view illustrating one step in the process of producing the container shown in FIG. 5.

FIG. 3 illustrates one step in a process of production of the flexible container according to the invention. Based on the hose-like blank illustrated in FIGS. 1–2, one half 10 of the blank is inserted through slot 8 and into the other half 11 as illustrated in FIG. 3. The material sections 3 and 4 between respectively slots 6–8 and 7–8 represent the two integral material areas 15, 16 extending from and connecting the outer sack or container portion 11′ to the inner sack or container portion 10′ at the respective sides of the container. A third material area 17 formed by the material section 5 between slots 6–7 extends in the opposite direction from the outer sack 11′ and continuing into the inner sack between the two material areas 15 and 16. During this operation the material areas 15 and 16 are rotated approximately 180° and they extend from the inner to the outer container.

Figure 4A:
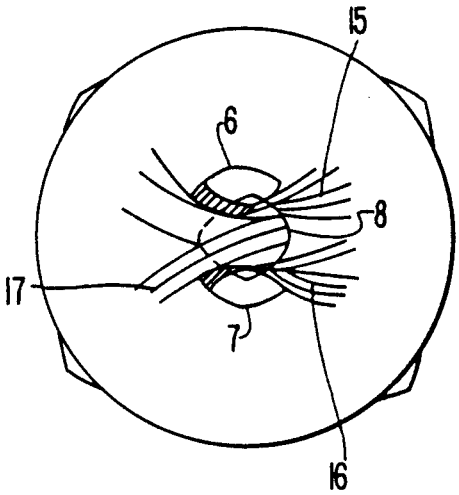
FIGS. 4*a*–4*c* are top views of the container of FIG. 5 on an enlarged scale.

FIG. 4*a* illustrates the flexible container seen from above. This example illustrates a hose-like blank 1 with three slots 6, 7 and 8. All three of the material areas 15, 16 and 17 represent a continuation of the walls in the inner and outer sacks in such way that each and every of the vertical fibers in the wall fabric of the sacks 10′ and 11′ extend through the lifting loop and carry the load of the container when it is lifted. Thus, the forces originating during lifting will be distributed uniformly and equally to the inner and outer sacks. This represents a major advantage for this invention, in that the volume of material can be increased without using new materials with higher strength modules and without reinforcing the container.

Figure 4B:
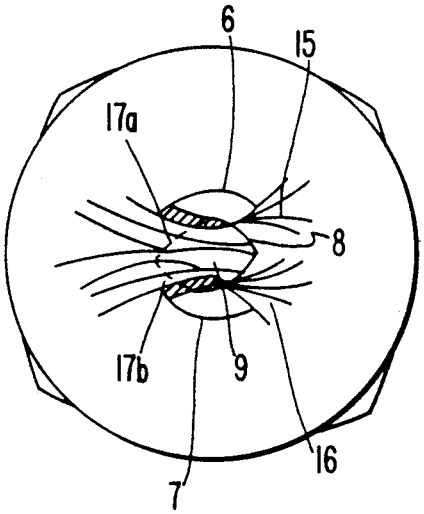
Figure 4C:
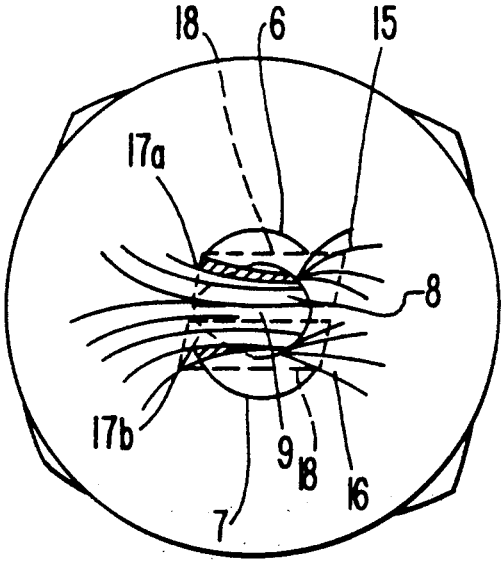

FIG. 4*b* illustrates a FIBC seen from above, manufactured by a hose-like blank with four slots 6, 7, 8 and 9. This manufacturing process gives four material areas 15, 16, 17*a* and 17*b*. The material areas 17*a* and 17*b* comprise respectively the material sections between the slots 6–7 and 7–9 and are not rotated. However, the material areas 15 and 16 comprising respectively the material sections between slots 6–8 and 7–8 are rotated approximately 180°. By collecting the material areas 15 and 17*a* and 15 and 17*b*, and if desired covering them by sleeves (e.g. as shown schematically at 18 in FIG. 4*c*), it is possible to form two lifting loops.

The examples described are FIBC's with three or four material areas formed by employing three or four slots, but it is evident that it is within the scope of the invention to employ more than three or four slots. The application of more slots will result in one or more of the material areas 15, 16, 17 being divided into several separate material sections.

The material areas 15, 16, 17 can if necessary be joined in one or more lifting areas, preferably including sleeves as discussed in NO Patent Specification No. 151,855. One common sleeve can cover all of the lifting loops or separate sleeves can be used.

Figure 5:
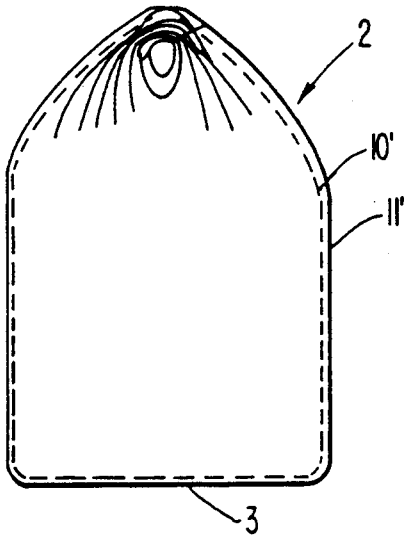
FIG. 5 is an elevation view illustrating the container with integrated lifting loops in a finished state.

FIG. 5 illustrates a finished container according to the invention. As previously mentioned, the hose-like blank forming the flexible container will be manufactured with a suitable common or separate bottom construction 3. A separate bottom construction can, for both the inner sack 10′ and the outer sack 11′, either be fastened prior to or after one half of the hose-like blank is inserted.

The invention provides a simple solution to the manufacturing process of a double walled flexible container including lifting loops integral with most of the longitudinal fibers in the material of the flexible container. These lifting loops provide a container that need be lifted only a slight height, and the lifting strain is also uniformly and equally distributed to the walls of the inner and outer sacks without any contractions in the fabric of the walls of the sacks.

All the aforementioned manufacturing steps for the flexible container according to the invention, i.e. cutting of the hose-like blank, insertion of one half part into the other half part, and the production of the bottom, can be achieved by use of relatively simple manufacturing equipment.

I claim:

1. A flexible intermediate bulk container for the transportation, storage and lifting of bulk material, said container comprising:

integral inner and outer container portions formed by inserting a first half of a tubular blank through a middle hole formed in the wall of said tubular blank, such that said first half fits within a second half of said tubular blank and said first half forms said inner container portion and said second half forms said outer container portion;

said wall of said tubular blank having formed therein first and second lateral holes on opposite sides of said middle hole with respect to the circumference of said tubular blank;

first and second material portions formed by the material of said tubular blank between said middle hole and said first and second lateral holes, respectively, said first and second material portions comprising integral connections between said outer and inner container portions at opposite sides thereof;

a third material portion formed by the material of said tubular blank between said first and second lateral holes, said third material portion comprising an integral connection between said outer and inner container portions at a position between said first and second material portions; and said first, second and third material portions being gathered to form at least one integral lifting loop for use in lifting said container.

2. A container as claimed in claim 1, wherein said first and second lateral holes are each spaced approximately 90° from said middle hole with respect to said circumference.

3. A container as claimed in claim 2, wherein said wall of said tubular blank has formed therein another hole at a position between said first and second lateral holes and opposite said middle hole with respect to said circumference.

4. A container as claimed in claim 1, wherein said wall of said tubular blank has formed therein another hole at a position between said first and second lateral holes and opposite said middle hole with respect to said circumference.

5. A container as claimed in claim 4, comprising two said lifting loops, a first said lifting loop being formed by said first material portion and one half of said third material portion, and a second said lifting loop being formed by said second material and another half of said third material portion.

6. A container as claimed in claim 5, further comprising sleeves covering said first and second lifting loops.

7. A container as claimed in claim 1, further comprising a sleeve covering said lifting loop.

8. A container as claimed in claim 1, wherein said middle hole and said lateral holes comprise slits formed longitudinally in said wall of said tubular blank.

9. A container as claimed in claim 8, wherein said slits all are of approximately the same length.

10. A container as claimed in claim 8, wherein said slit forming said middle hole is of a length different from said slits forming said lateral holes.

11. A container as claimed in claim 8, wherein said slits all are positioned approximately at the middle of the length of said tubular blank.

12. A container as claimed in claim 11, wherein said slit forming said middle hole extends further into the material of said outer container portion than into the material of said inner container portion.

13. A process of manufacturing a flexible intermediate bulk container to be employed for the transportation, storage and lifting of bulk material, said process comprising:

providing an elongated tubular blank of suitable material;

forming in the wall of said tubular blank a middle hole and first and second lateral holes on opposite sides of said middle hole with respect to the circumference of said tubular blank;

inserting a first half of said tubular blank through said middle hole, such that said first half fits within a second half of said tubular blank, and whereby said first half forms an inner container portion and said second half forms an outer container portion integral with said inner container portion;

thereby defining first and second material portions by the material of said tubular blank between said middle hole and said first and second lateral holes, respectively, such that said first and second material portions form integral connections between said outer and inner container portions on opposite sides thereof;

thereby further defining a third material portion by the material of said tubular blank between said first and second lateral holes, such that said third material portion forms an integral connection between said outer and inner container portions at a position between said first and second material portions; and said first, second and third material portions capable of being gathered to form at least one lifting loop for use in lifting said container.

14. A process as claimed in claim 13, comprising spacing said first and second lateral holes approximately 90° from said middle hole with respect to said circumference.

15. A process as claimed in claim 14, comprising forming in said wall of said tubular blank another hole at a position between said first and second lateral holes and opposite said middle hole with respect to said circumference.

16. A process as claimed in claim 14, comprising forming in said wall of said tubular blank another hole at a position between said first and second lateral holes and opposite said middle hole with respect to said circumference.

17. A process as claimed in claim 16, further comprising gathering said first material portion and one half of said third material portion to thereby form a first lifting loop, and gathering said second material portion and another half of said third material portion to thereby form a second lifting loop.

18. A process as claimed in claim 17, further comprising covering said first and second lifting loops with respective sleeves.

19. A process as claimed in claim 13, comprising gathering said material portions and thereby forming at least one lifting loop.

20. A process as claimed in claim 19, further comprising covering said lifting loop with a sleeve.

21. A process as claimed in claim 13, comprising forming said middle hole and said lateral holes as slits extending longitudinally of said tubular blank.

22. A process as claimed in claim 21, comprising forming all of said slits of approximately the same length.

23. A process as claimed in claim 21, comprising forming said slit of said middle hole to be of a length different from said slits forming said lateral holes.

24. A process as claimed in claim 21, comprising forming said slits to all be positioned approximately at the middle of the length of said tubular blank.

25. A process as claimed in claim 24, comprising forming said slit of said middle hole to extend further into the material of said outer container portion than into the material of said inner container portion.

* * * * *